US010428296B2

(12) United States Patent
Schramm, Jr. et al.

(10) Patent No.: US 10,428,296 B2
(45) Date of Patent: Oct. 1, 2019

(54) UNIT DOSE FABRIC SOFTENER

(71) Applicant: Colgate-Palmolive Company, New York, NY (US)

(72) Inventors: Charles Schramm, Jr., Hillsborough, NJ (US); Katie Truong, Piscataway, NJ (US)

(73) Assignee: Colgate-Palmolive Company, New York, NY (US)

( * ) Notice: Subject to any disclaimer, the term of this patent is extended or adjusted under 35 U.S.C. 154(b) by 17 days.

(21) Appl. No.: 15/533,485

(22) PCT Filed: Dec. 22, 2014

(86) PCT No.: PCT/US2014/071828

§ 371 (c)(1),
(2) Date: Jun. 6, 2017

(87) PCT Pub. No.: WO2016/105333

PCT Pub. Date: Jun. 30, 2016

(65) Prior Publication Data

US 2017/0342347 A1 Nov. 30, 2017

(51) Int. Cl.

| | |
|---|---|
| ***C11D 17/00*** | (2006.01) |
| ***C11D 3/37*** | (2006.01) |
| ***C11D 1/62*** | (2006.01) |
| ***C11D 1/835*** | (2006.01) |
| ***C11D 3/00*** | (2006.01) |
| ***C11D 3/20*** | (2006.01) |
| ***C11D 3/43*** | (2006.01) |
| ***C11D 3/50*** | (2006.01) |
| ***C11D 17/04*** | (2006.01) |
| *C11D 1/72* | (2006.01) |

(52) U.S. Cl.

CPC ..... *C11D 3/3773* (2013.01); *C11D 1/62* (2013.01); *C11D 1/835* (2013.01); *C11D 3/0015* (2013.01); *C11D 3/2041* (2013.01); *C11D 3/2065* (2013.01); *C11D 3/2068* (2013.01); *C11D 3/3738* (2013.01); *C11D 3/3749* (2013.01); *C11D 3/43* (2013.01); *C11D 3/505* (2013.01); *C11D 17/043* (2013.01); *C11D 1/72* (2013.01)

(58) Field of Classification Search

CPC ..... C11D 3/001; C11D 1/62; C11D 17/0039; C11D 3/0015; C11D 3/373; C11D 17/041; C11D 17/043; C11D 3/50; C11D 1/835

See application file for complete search history.

(56) References Cited

U.S. PATENT DOCUMENTS

| | | | | |
|---|---|---|---|---|
| 6,294,516 | B1 | 9/2001 | Jacques et al. | |
| 6,492,315 | B1 | 12/2002 | Cao et al. | |
| 6,605,581 | B1 | 8/2003 | Cao et al. | |
| 6,864,223 | B2 | 3/2005 | Smith et al. | |
| 7,056,877 | B2 | 6/2006 | Caswell et al. | |
| 7,494,965 | B2 | 2/2009 | Caswell et al. | |
| 7,674,758 | B2 | 3/2010 | Wahl et al. | |
| 2004/0142840 | A1 | 7/2004 | de Buzzaccarini et al. | |
| 2008/0076698 | A1 | 3/2008 | Jacques et al. | |
| 2013/0059767 | A1 | 3/2013 | Subramanyam et al. | |
| 2016/0024427 | A1* | 1/2016 | Sivik ..... | C11D 1/62 8/137 |

FOREIGN PATENT DOCUMENTS

| | | |
|---|---|---|
| EP | 1431383 | 3/2006 |
| WO | WO 2011/149475 | 12/2011 |
| WO | 2012/072369 | 6/2012 |

OTHER PUBLICATIONS

International Search Report and Written Opinion of the International Searching Authoirty in International Application No. PCT/US2015/071828, dated Sep. 2, 2015.

* cited by examiner

*Primary Examiner* — John R Hardee

(57) ABSTRACT

A unit dose fabric conditioner that contains a combination of a polyol, alkoxylated alcohol, and dispersing polymer to allow for incorporation of encapsulated fragrance slurries into unit dose fabric conditioners to disperse the encapsulated fragrance and fabric conditioner active during laundering.

16 Claims, No Drawings

UNIT DOSE FABRIC SOFTENER

BACKGROUND

Unit dose products provide convenience to consumers to be able to quickly and easily add a desired amount of product to laundry. One such product is fabric conditioner. To improve on fabric conditioners, it would be desirable to add encapsulated fragrances that can be delivered during the wash. A problem with encapsulated fragrances is that they are typically supplied in a suspension with more than 50 weight % water. This water creates instability in the water soluble pouch that contains the product. Also, there is a need to disperse fragrance capsules to obtain a more evenly distributed deposition of the fragrance capsules on fabric. Also, there is a need to disperse the fabric conditioner throughout the wash.

BRIEF SUMMARY

It has been found that a combination of a polyol, alkoxylated alcohol, and dispersing polymer allows for incorporation of encapsulated fragrance slurries into unit dose fabric conditioners to disperse the encapsulated fragrance and fabric conditioner active during laundering.

In one embodiment, a unit dose fabric conditioner comprising a fabric conditioner composition contained within a water soluble pouch, wherein the composition is liquid at 25° C. and comprises:

a cationic fabric softening active;

at least 50% by weight of the composition of a $C_3$-$C_{12}$ polyol that is liquid at 25° C.;

a $C_9$-$C_{15}$ alkoxylated alcohol having an average of 3 to 8 EO per mole and which is liquid at 25° C.;

a dispersing polymer for dispersing the cationic fabric softening active; and encapsulated fragrance.

Also, a method of laundering fabric with the unit dose fabric conditioner.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The cationic softener can be any cationic softener. In certain embodiments, the cationic softener is an esterquat, tallow esterquat, triolyeyl esterquat, and diolyeyl esterquat.

In one embodiment, the esterquat is diolyel esterquat. In one embodiment, the tallow esterquat is described in WO2011149475.

The esterquats can be represented by the following structure:

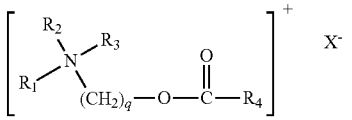

wherein $R_4$ represents an aliphatic hydrocarbon group having from 8 to 22 carbon atoms, $R_2$ and $R_3$ represent $(CH_2)_s$—$R_5$ where $R_5$ represents an alkoxy carbonyl group containing from 8 to 22 carbon atoms, benzyl, phenyl, ($C_1$-$C_4$)-alkyl substituted phenyl, OH or H; R1 represents $(CH_2)_t$ $R_6$ where $R_4$ represents benzyl, phenyl, ($C_1$-$C_4$)-alkyl substituted phenyl, OH or H; q, s, and t, each independently, represent an integer from 1 to 3; and X' is a softener compatible anion.

The composition contains encapsulated fragrance. The encapsulated fragrance can be supplied as a suspension containing water. In certain embodiments, the encapsulated fragrance can be included in the composition in an amount of 1 to 10% by weight of the composition.

The water soluble pouch can be any material that is typically used for making a unit dose film. These materials include, but are not limited to polyvinyl alcohol. The thickness of the film that makes the pouch can be any desired thickness. In certain embodiment, the thickness is 25 to 150 microns. The thickness is chosen based on the desired dissolvability of the film.

In one embodiment, provided is Composition 1 that is a unit dose fabric conditioner comprising a fabric conditioner composition contained within a water soluble pouch, wherein the composition is liquid at 25° C. and comprises:

a cationic fabric softening active;

at least 50% by weight of the composition of a $C_3$-$C_{12}$ polyol that is liquid at 25° C.;

a $C_9$-$C_{15}$ alkoxylated alcohol having an average of 3 to 8 EO per mole and which is liquid at 25° C.;

a dispersing polymer for dispersing the cationic fabric softening active; and encapsulated fragrance.

1.1 The unit dose fabric conditioner of any preceding Composition, wherein the water soluble pouch comprises polyvinyl alcohol.

1.2 The unit dose fabric conditioner of any preceding Composition, wherein the composition further comprises free fragrance.

1.3 The unit dose fabric conditioner of Composition 1.2, wherein the free fragrance is present in an amount of 0.5 to 7% by weight of the composition.

1.4 The unit dose fabric conditioner of any preceding Composition, wherein the encapsulated fragrance is present in an amount of 1 to 10% by weight of the composition.

1.5 The unit dose fabric conditioner of any preceding Composition, wherein the cationic fabric softening active is at least one active chosen from esterquat, tallow esterquat, triolyeyl esterquat, and diolyeyl esterquat.

1.6 The unit dose fabric conditioner of any preceding Composition, wherein the cationic fabric softener is present in an amount of 10 to 30% by weight of the composition.

1.7 The unit dose fabric conditioner of any preceding Composition, wherein the cationic fabric softener is liquid at 25° C.

1.8 The unit dose fabric conditioner of any preceding Composition, wherein the cationic fabric softener is diolyeyl esterquat.

1.9 The unit dose fabric conditioner of any preceding Composition, wherein the polyol is at least one polyol chosen from glycerin, propylene glycol, diglycerol, triglycerol, and quadraglycerol.

1.10 The unit dose fabric conditioner of any preceding Composition, wherein the polyol is present in an amount of 50 to 90% by weight of the composition.

1.11 The unit dose fabric conditioner of any preceding Composition, wherein the polyol is present in an amount of 50 to 80% by weight of the composition.

1.12 The unit dose fabric conditioner of any preceding Composition, wherein the polyol is present in an amount of 60 to 80% by weight of the composition.

1.13 The unit dose fabric conditioner of any preceding Composition, wherein the polyol is present in an amount of 60 to 70% by weight of the composition.

1.14 The unit dose fabric conditioner of any preceding Composition, wherein the alkoxylated alcohol is present in an amount of 2 to 8 weight % by weight of the composition.

1.15 The unit dose fabric conditioner of any preceding Composition, wherein the alkoxylated alcohol is present in an amount of 6 weight % by weight of the composition.

1.16 The unit dose fabric conditioner of any preceding Composition, wherein the alkoxylated alcohol is at least one alkoxylated alcohol chosen from a $C_9$-$C_{11}$ alkoxylated alcohol with an average of 8 EO, $C_{12}$-$C_{13}$ alkoxylated alcohol with an average of 5 EO, and $C_{12}$-$C_{13}$ alkoxylated alcohol with an average of 7 EO.

1.17 The unit dose fabric conditioner of any preceding Composition, wherein the alkoxylated alcohol is a $C_9$-$C_{11}$ alkoxylated alcohol with an average of 8 EO.

1.18 The unit dose fabric conditioner of any preceding Composition, wherein the dispersing polymer is a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent. Examples of these types of polymers are available from SNF Floerger.

1.19 The unit dose fabric conditioner of any preceding Composition, wherein the dispersing polymer is present in an amount of 0.2 to 2% by weight of the composition.

1.20 The unit dose fabric conditioner of any preceding Composition, wherein the dispersing polymer is present in an amount of 0.2 to 0.5% by weight of the composition.

1.21 The unit dose fabric conditioner of any preceding Composition, wherein the dispersing polymer is present in an amount of 0.3 to 0.35% by weight of the composition.

1.22 The unit dose fabric conditioner of any preceding Composition, wherein the composition contains water in an amount of 0 to 10% by weight of the composition.

1.23 The unit dose fabric conditioner of Composition 1.22, wherein the amount of water is 0 to 7% by weight of the composition, and the water soluble pouch has a thickness of 35 to 40 microns.

1.24 The unit dose fabric conditioner of Composition 1.22, wherein the amount of water is 0 to 9% by weight of the composition, and the water soluble pouch has a thickness of 70 to 80 microns.

1.25 The unit dose fabric conditioner of any preceding Composition, wherein the composition further comprises at least one material chosen from PPG-2-myristyl ether propionate, propylene/hexene maleic terminated copolymer with a weight average molecular weight of about 800, and a polyether-alkyl-polymethyl-siloxane copolymer.

1.26 The unit dose fabric conditioner of any preceding Composition, wherein the composition is non-Newtonian and has a viscosity of 200 to 1000 mPas as measured on a Brookfield LVT viscometer with spindle 4 at 12 rpm, optionally 200 to 800 mPas.

1.27 The unit dose fabric conditioner of any of Compositions 1 to 1.25, wherein the composition is Newtonian and has a viscosity of 200 to 1000 mPas as measured on a Brookfield LVT viscometer with spindle 2 at 30 rpm, optionally 200 to 800 mPas.

Any of the preceding unit dose fabric conditioners can be used in a laundry process to condition fabrics. The unit dose can be added to the wash cycle, the rinse cycle, or both.

Liquid at 25° C. refers to the ordinary definition of a liquid in which the material conforms to the shape of the container that it is in. In certain embodiments, liquid at 25° C. refers to a material that is liquid and when added to the composition, the composition has a viscosity of 200 to 1000 or 200 to 800 mPas as measured above.

The compositions can contain any typical additive, such as coloring agents, pH adjusting agents, preservatives, antifoams, and silicones.

EXAMPLES

Exemplary compositions were prepared as detailed in the tables below. The compositions were prepared by mixing of the materials.

| Material | A | B | C | D | E | F | G | H |
|---|---|---|---|---|---|---|---|---|
| Soft Tallow Triesterquat TriOleyl Esterquat DiOleyl Esterquat 50/50 Hard/Soft Esterquat from WO2011149475 | 19.1% | 19.2% | 19.4% | 19.1% | 14.8% | 19.9% | 20.7% | 20.8% |
| Glycerin | 58.7% | 59% | 59.7% | 58.6% | 61.8% | 61.2% | 63.7% | 64% |
| Free Fragrance | 5.1% | 5.1% | 5.2% | 5.1% | 5.4% | 4% | 2.6% | 1.8% |
| Neodol 91-8 $C_9$-$C_{11}$ alkoxylated alcohol with an average of 8EO | 2.6% | 2.6% | 2.6% | 3.3% | 2.7% | 3.5% | 3.6% | 3.6% |
| Water soluble cross-linked cationic polymer from SNF Floerger 2243-5 polymer | 2.1% | 2.1% | 2.1% | 1.6% | 2.2% | 2.2% | 2.3% | 2.3% |

-continued

| | | | | | | | | |
|---|---|---|---|---|---|---|---|---|
| Propylene/Hexene Maleic Terminated copolymer with 800 MW from Baker Hughes | 0.5% | | | 0.5% | 0.5% | | | |
| Deionized water | 2.4% | 2.4% | 2.5% | 2.4% | 2.6% | 2.5% | 2.6% | 2.6% |
| Fragrance Capsules | 8.1% | 8.1% | 8.2% | 8.1% | 8.5% | 6.3% | 4.1% | 2.9% |
| Tegopren 7008 polyether-alkyl-polymethyl-siloxane copolymer from Evonik | 1.1% | 1.1% | | 1.1% | 1.2% | | | |
| Minors (color and pH adjust) | Q.S. | Q.S. | Q.S. | Q.S. | Q.S. | Q.S. | Q.S. | Q.S. |
| Crodamol PMP PPG-2 myristyl ether propionate | | | | | | | | 1.6% |

| Material | I | J | K | L | M | N | O | P |
|---|---|---|---|---|---|---|---|---|
| Soft Tallow Triesterquat | | | | | | | | |
| TriOleyl Esterquat | | 38.8% | | | | | | |
| DiOleyl Esterquat | | | 14.8% | 38.8% | | | | |
| 50/50 Hard/Soft Esterquat from WO2011149475 | 20.8% | | | | 20.5% | 21% | 20.7% | 20.5% |
| Glycerin | 64% | | 61.8% | | 63.2% | 64.5% | 63.7% | 63% |
| Free Fragrance | 1.8% | 14.1% | 5.4% | 14.1% | 1.8% | 1% | 1% | 0.8% |
| Neodol 91-8 $C_9$-$C_{11}$ alkoxylated alcohol with an average of 8EO | 3.6% | 7.1% | 2.7% | 7.1% | 3.6% | 3.7% | 3.6% | 3.6% |
| Water soluble cross-linked cationic polymer from SNF Floerger 2243-5 polymer | 2.3% | 5.8% | 2.2% | 5.8% | 2.3% | 2.3% | 2.3% | 2.3% |
| Propylene/Hexene Maleic Terminated copolymer with 800 MW from Baker Hughes | | 1.4% | 0.5% | 1.4% | | | | |
| Deionized water | 2.6% | 6.7% | 2.6% | 6.7% | 2.6% | 2.7% | 2.6% | 2.6% |
| Fragrance Capsules | 2.9% | 22.2% | 8.5% | 22.2% | 4.2% | 2.9% | 4.1% | 5.4% |
| Tegopren 7008 polyether-alkyl-polymethyl-siloxane copolymer from Evonik | | 3% | 1.2% | 3% | | | | |
| Minors (color and pH adjust) | Q.S. | Q.S. | Q.S. | Q.S. | Q.S. | Q.S. | Q.S. | Q.S. |
| Crodamol PMP PPG-2 myristyl ether propionate | 1.6% | | | | 1.5% | 1.6% | 1.6% | 1.5% |

| Material | Q | R | S | T | U | V | W | X |
|---|---|---|---|---|---|---|---|---|
| Soft Tallow Triesterquat | | | 21% | 16.6% | | 21% | 20.8% | |
| TriOleyl Esterquat | | | | | | | | |
| DiOleyl Esterquat | | | | | | | | |
| 50/50 Hard/Soft Esterquat from WO2011149475 | 20.8% | 16.4% | | | 21% | | | 20.8% |
| Glycerin | 63.9% | 67.4% | 64.5% | 68.1% | 64.5% | 64.6% | 63.9% | 63.9% |
| Free Fragrance | 1.8% | 1.9% | 1.1% | 1.1% | 1.4% | 1.4% | 1.8% | 1.8% |
| Neodol 91-8 $C_9$-$C_{11}$ alkoxylated alcohol with an average of 8EO | 3.6% | 3.8% | 3.7% | 3.9% | 3.7% | 3.7% | 3.6% | 3.6% |
| Water soluble cross-linked cationic polymer from SNF Floerger 2243-5 polymer | 2.3% | 2.4% | 2.3% | 2.4% | 2.3% | 2.3% | 2.3% | 2.3% |
| Propylene/Hexene Maleic Terminated copolymer with 800 MW from Baker Hughes | | | | | | | | |
| Deionized water | | | 2.7% | 2.8% | 1.3% | 1.3% | 1.3% | 1.3% |
| Fragrance Capsules | 4.2% | 4.4% | 2.9% | 3.1% | 3.6% | 3.6% | 4.2% | 4.2% |
| Tegopren 7008 polyether-alkyl-polymethyl-siloxane copolymer from Evonik | | | | | | | | |
| Minors (color and pH adjust) | Q.S. | Q.S. | Q.S. | Q.S. | Q.S. | Q.S. | Q.S. | Q.S. |
| Crodamol PMP PPG-2 myristyl ether propionate | 1.6% | 1.6% | 1.6% | 1.7% | 1.6% | 1.6% | 1.6% | 1.6% |

Each of compositions A to X was able to disperse the esterquat and fragrance capsules.

Without either, the alkoxylated alcohol ($C_9$-$C_{11}$ alkoxylated alcohol with an average of 8 EO) or the dispersing polymer (water soluble cross-linked cationic polymer), dispersability of the esterquat and fragrance capsules was not observed.

PEG 400 and PEG 600 were tested in place of the polyol. Dispersability was not observed with these PEGs.

What is claimed is:

1. A unit dose fabric conditioner comprising a fabric conditioner composition contained within a water soluble pouch, wherein the composition is liquid at 25° C. and comprises:

a) a cationic fabric softening active, wherein the cationic fabric softening active is at least one active chosen from esterquat, tallow esterquat, triolyeyl esterquat, and diolyeyl esterquat;

b) at least 50% by weight of the composition of a $C_3$-$C_{12}$ polyol that is liquid at 25° C.;

c) a $C_9$-$C_{15}$ alkoxylated alcohol having an average of 3 to 8 EO per mole and which is liquid at 25° C.;

d) a dispersing polymer for dispersing the cationic fabric softening active; and encapsulated fragrance;

wherein the alkoxylated alcohol is present in an amount of 2.6 to 7.1% by weight of the composition; and wherein the dispersing polymer is present in an amount of 1.6 to 5.8% by weight of the composition.

2. The unit dose fabric conditioner of claim 1, wherein the water soluble pouch comprises polyvinyl alcohol.

3. The unit dose fabric conditioner of claim 1, wherein the composition further comprises free fragrance, and wherein the free fragrance is present in an amount of 0.5 to 7% by weight of the composition.

4. The unit dose fabric conditioner of claim 1, wherein the encapsulated fragrance is present in an amount of 1 to 10% by weight of the composition.

5. The unit dose fabric conditioner of claim 1, wherein the cationic fabric softener is present in an amount of 10 to 30% by weight of the composition.

6. The unit dose fabric conditioner of claim 1, wherein the cationic fabric softener is diolyeyl esterquat and wherein the cationic fabric softener is liquid at 25° C.

7. The unit dose fabric conditioner of claim 1, wherein the polyol is at least one polyol chosen from glycerin, propylene glycol, diglycerol, triglycerol, and quadraglycerol.

8. The unit dose fabric conditioner of claim 1, wherein the polyol is present in an amount of 50 to 90% by weight of the composition.

9. The unit dose fabric conditioner of claim 1, wherein the polyol is present in an amount of 60 to 70% by weight of the composition.

10. The unit dose fabric conditioner of claim 1, wherein the alkoxylated alcohol is at least one alkoxylated alcohol chosen from a C9-C11 alkoxylated alcohol with an average of 8 EO, C12-C13 alkoxylated alcohol with an average of 5 EO, and C12-C13 alkoxylated alcohol with an average of 7 EO.

11. The unit dose fabric conditioner of claim 1, wherein the dispersing polymer is a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent.

12. The unit dose fabric conditioner of claim 1, wherein the composition contains water in an amount of 0 to 7% by weight of the composition, and the water soluble pouch has a thickness of 35 to 40 microns.

13. The unit dose fabric conditioner of claim 1, wherein the composition further comprises at least one material chosen from PPG-2-myristyl ether propionate, propylene/hexene maleic terminated copolymer with a weight average molecular weight of about 800, and a polyether-alkyl-polymethyl-siloxane copolymer.

14. The unit dose fabric conditioner of claim 1, wherein the composition is non-newtonian and has a viscosity of 200 to 1000 mPas as measured on a Brookfield LVT viscometer with spindle 4 at 12 rpm.

15. The unit dose fabric conditioner of claim 1, wherein the composition is newtonian and has a viscosity of 200 to 800 mPas as measured on a Brookfield LVT viscometer with spindle 2 at 30 rpm.

16. Method of conditioning fabrics comprising adding the unit does fabric conditioner of claim 1 to laundry during at least one of wash and rinse.

* * * * *